US010065235B2

(12) United States Patent
Zieve et al.

(10) Patent No.: US 10,065,235 B2
(45) Date of Patent: Sep. 4, 2018

(54) SYSTEM USING AN AIR GAP FOR WORKPIECE PROTECTION IN A FASTENER MACHINE

(71) Applicant: Electroimpact, Inc., Mukilteo, WA (US)

(72) Inventors: Peter B. Zieve, Seattle, WA (US); Reese R. Allen, Seattle, WA (US); Cosmos G. Krejci, Ames, IA (US)

(73) Assignee: Electroimpact, Inc., Mukilteo, WA (US)

( * ) Notice: Subject to any disclaimer, the term of this patent is extended or adjusted under 35 U.S.C. 154(b) by 925 days.

(21) Appl. No.: 14/491,068

(22) Filed: Sep. 19, 2014

(65) Prior Publication Data

US 2016/0082501 A1 Mar. 24, 2016

(51) Int. Cl.

| | |
|---|---|
| ***B21J 15/28*** | (2006.01) |
| ***B21J 15/02*** | (2006.01) |
| ***B21J 15/26*** | (2006.01) |
| ***B21J 15/32*** | (2006.01) |
| ***B21J 15/14*** | (2006.01) |

(52) U.S. Cl.

CPC ..... *B21J 15/28* (2013.01); *B21J 15/02* (2013.01); *B21J 15/142* (2013.01); *B21J 15/26* (2013.01); *B21J 15/285* (2013.01); *B21J 15/32* (2013.01)

(58) Field of Classification Search

CPC . B21J 15/28; B21J 15/02; B21J 15/142; B21J 15/26; B21J 15/285; B21J 15/32

USPC ..... 227/2–3, 112, 119, 121

See application file for complete search history.

(56) References Cited

U.S. PATENT DOCUMENTS

| | | | | |
|---|---|---|---|---|
| 5,661,887 A * | 9/1997 | Byrne | ..... | B21J 15/105 227/2 |
| 5,666,710 A * | 9/1997 | Weber | ..... | B21J 15/105 227/2 |
| 2002/0029450 A1* | 3/2002 | Kondo | ..... | B21J 15/025 29/407.01 |

FOREIGN PATENT DOCUMENTS

| | | | | |
|---|---|---|---|---|
| EP | 0468717 B1 * | 3/1995 | ..... | B21J 15/105 |

* cited by examiner

*Primary Examiner* — Michelle Lopez

(74) *Attorney, Agent, or Firm* — Jensen & Puntigam, P.S.

(57) ABSTRACT

The system includes a ram assembly with fingers for grasping a fastener. An actuator moves the ram assembly toward the workpiece, under machine control. A housing member which is movable by the actuator includes a holding member for an anvil portion of the ram assembly, the holding member being movable within the housing member. The holding member and the housing member are arranged so there is a selected air gap between the movable member and the top of the housing at the start of the fastener cycle. An insertion sensor assembly changes signal state when the air gap begins to close. When the air gap begins to close either too early or too late relative to a properly positioned fastener, the actuator is stopped by the cycle motion controller.

11 Claims, 14 Drawing Sheets

SYSTEM USING AN AIR GAP FOR WORKPIECE PROTECTION IN A FASTENER MACHINE

TECHNICAL FIELD

This invention relates generally to automatic riveting machines used for large-scale manufacturing operations using fasteners, such as for commercial aircraft, and more specifically concerns a system for preventing damage to an aircraft workpiece or the like in the event of a fastener misalignment.

BACKGROUND OF THE INVENTION

Automatic riveting machines can have various configurations, including a C-frame arrangement, such as shown in FIG. 1, a rectangular D-frame arrangement, or other machine arrangement with the part held in a horizontal plane and with the riveting axis in a generally vertical orientation or a gantry-type machine with the part vertical and the riveting axis horizontal. All of these machines use generally the same mechanism for carrying a rivet or bolt to a drilled opening in the workpiece, the carrying mechanism being positioned on the end of a ram and including spring-loaded gripping fingers for the fastener.

These machines use a CMC for control of rivet upset and logic. A CMC is both a logic controller and a motion controller, controlled by one processor or multiple processors connected together. The CMC controls upper and lower rams (or front and back rams) of a riveting machine and applies logic and timing to the motion control of the machine, as well as recognizing input and output information. Examples of CMCs include Delta Tau PMAC controller, Fanuc controllers and Siemens controllers.

A large ram force produced by an actuator is necessary to upset a rivet after it has been positioned in the workpiece opening or to drive a bolt into an interference fit in an opening in the workpiece. A rivet or bolt may in some cases not successfully initially enter the opening, because it is jammed between the ram die and the workpiece or turned sideways (laid down). In either case, when the riveting or interference force is applied to the misaligned fastener, the resulting damage to the workpiece can result in the entire workpiece being ruined, with a substantial monetary loss.

Accordingly, it is desirable that the manufacturing apparatus be able to automatically detect when a fastener (rivet or bolt) is not positioned properly in the workpiece prior to the application of the large ram force. One previous approach in solving this problem uses a camera to ensure proper insertion of the fastener. While this has been generally successful, it has limitations with respect to certain types of fastener misalignment and is insensitive to the case where the rivet is misaligned perpendicular to the view of the camera. Such a vision system also is expensive and has the further disadvantage of slowing down the fastening process, because the machine must actually stop during every cycle to perform a vision check.

In another previous approach, the push-away of the lower clamp portion of a riveting system is sensed. A lower clamp is held against the workpiece pneumatically in riveting operations. In a normal rivet cycle, the lower clamp is not pushed away but in the case of a rivet jam or a sideways, laid-down situation, the lower clamp is pushed away from the workpiece. While this technique is effective in reducing damage, it does not prevent it, since the clamp motion which is sensed has already resulted in at least some workpiece damage before the riveting force is interrupted. The lower clamp push-away technique cannot be used for bolts, however, because the lower clamp is not held pneumatically against the workpiece for bolt insertion. The full unexpected force can be detected by a load cell arrangement but catastrophic damage is done to the workpiece before the motion of the ram is stopped.

Accordingly, existing systems for preventing damage due to misaligned rivets and bolts are not completely satisfactory. It is important that all or virtually all instances of misalignment be quickly recognized and the fastener process interrupted prior to the application of fastening force and resulting damage to the workpiece.

SUMMARY OF THE INVENTION

Accordingly, the system for accomplishing riveting or bolt insertion into an opening in a workpiece without damage to the workpiece includes: a ram assembly, having fingers at a forward end thereof for grasping a fastener; an actuator for moving the ram assembly under control of a cycle motion controller for initially inserting the fastener into an opening in the workpiece and thereafter accomplishing an insertion cycle for the fastener to complete insertion of the fastener in the opening; a protective air gap assembly responsive to movement of the ram assembly toward the workpiece, including an air gap which is maintained by a selected amount of force; and a sensor assembly mounted and operable to determine closing of the air gap due to movement of the ram assembly toward the workpiece, wherein the sensor has a signal state which is monitored by the cycle motion controller, the insertion cycle being interrupted prior to damage being done to the workpiece in the event that the air gap begins to close too early or too late relative to closure of the air gap when the fastener is properly initially inserted in the workpiece opening.

BEST MODE FOR CARRYING OUT THE INVENTION

Figure 1:
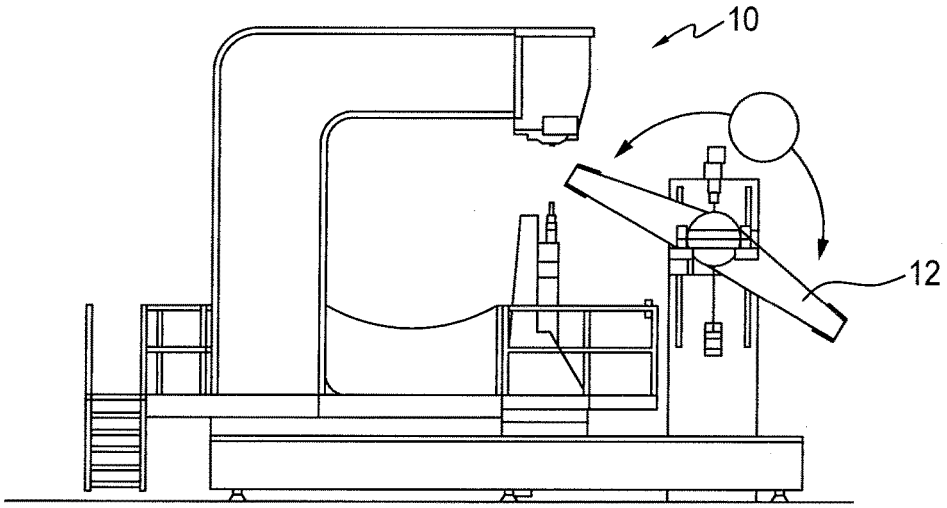
FIG. 1 is a simplified elevational view of a C-clamp automatic riveting machine.

FIG. 1 shows a conventional C-frame riveting machine, generally at 10. Current automatic riveting machines upset a rivet which has been positioned in an opening in a workpiece 12, such as an aircraft panel, with riveting rams on both sides of the workpiece controlled by electric servomotors and a cycle motion controller, described in more detail immediately below. The term cycle motion controller (CMC) is intended to be a broad term covering a variety of machine controllers for riveting and bolt insertion functions.

Figure 2:
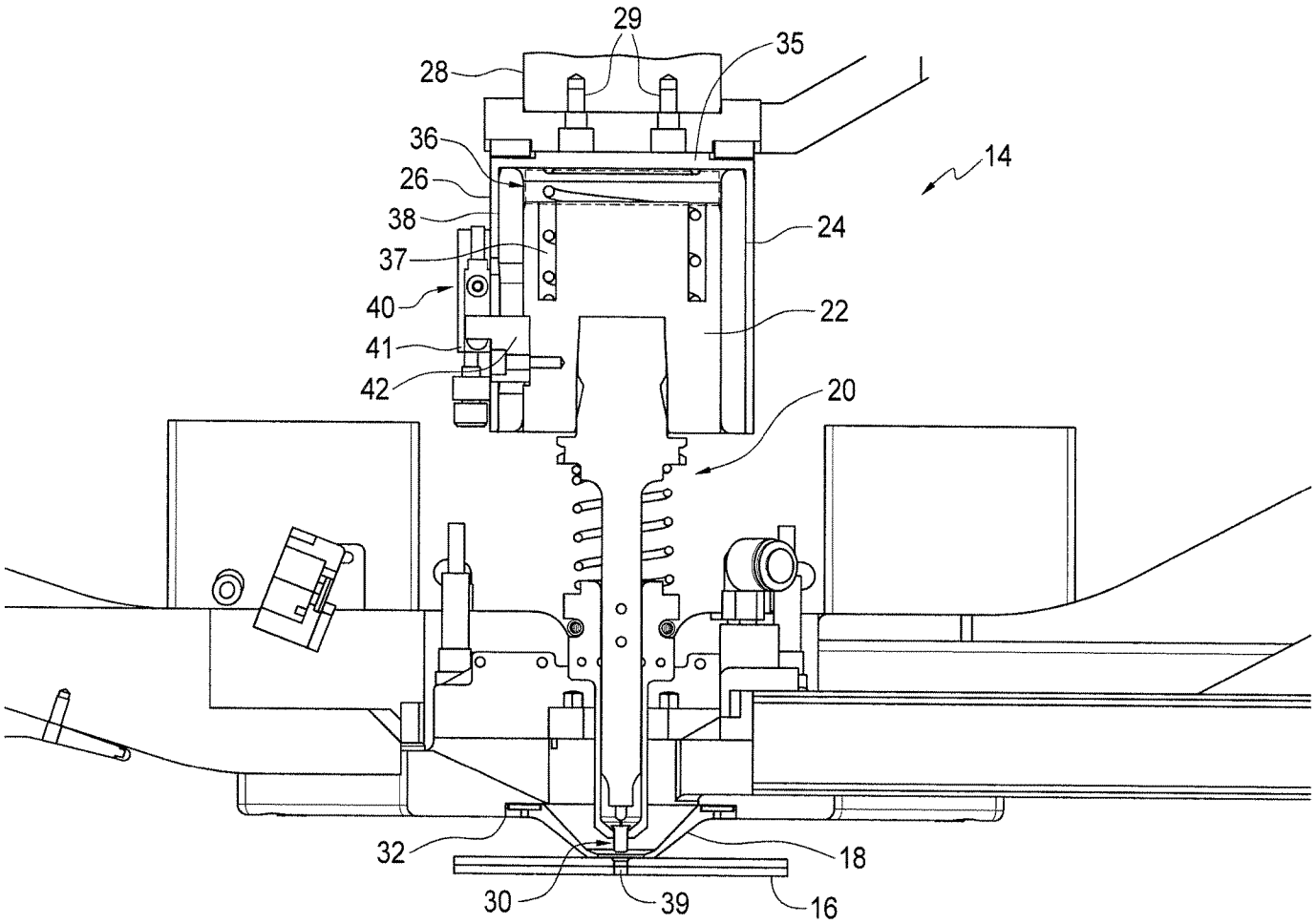
FIG. 2 is a cross-sectional view of a portion of a riveting system.

FIG. 2 shows a servo-controlled ram assembly on the insertion side of the workpiece 16. The assembly generally includes a pressure foot/clamp pad 18 and a rivet anvil or ram 20 mounted in an anvil socket 22. The anvil socket is surrounded by a bushing 24 which itself is contained within an outer housing 26. A forward end 28 of an actuator shaft is attached to the housing by bolts 29 or the like, with the actuator being controlled by a servo motor (not shown in FIG. 2). FIG. 2 further shows a rivet 30 held by a conventional finger assembly 32.

In the present invention, there is an air gap 36 of approximately 10 mm located between an upper end of anvil socket 22 and a top end 35 of housing 26. A spring 38 is positioned within a slot 37 in the anvil socket, the spring extending into air gap 36. Spring 38 holds the air gap open with about 60-75 pounds of force. Alternatively, the air gap can be held open by fluid pressure or by gravity action. The air gap 36 in effect creates a lost motion of the ram-to-die arrangement during insertion of the rivet into the opening 39 of the workpiece. The spring force passes through the ram-to-die connection when the rivet is fully inserted into the opening. The system further includes a sensor assembly 40 attached to the housing, the sensor assembly including a lower sensing element 41, while a flag member 42 is attached to anvil socket 22. In operation, as the flag member 42 moves with the anvil socket, the air gap decreases and sensing element 41 is uncovered, changing the signal state of the sensor. This occurs whether the rivet is properly inserted or not. However, if the change of state is early, i.e. prior to the normal expected time for a properly inserted rivet, as explained in more detail below, the CMC recognizes an error and interrupts (halts) the riveting cycle, i.e. the application of riveting force to the rivet. The action of the sensor assembly, the flag and the cycle motion controller (CMC) is also explained in more detail below.

Figure 3:
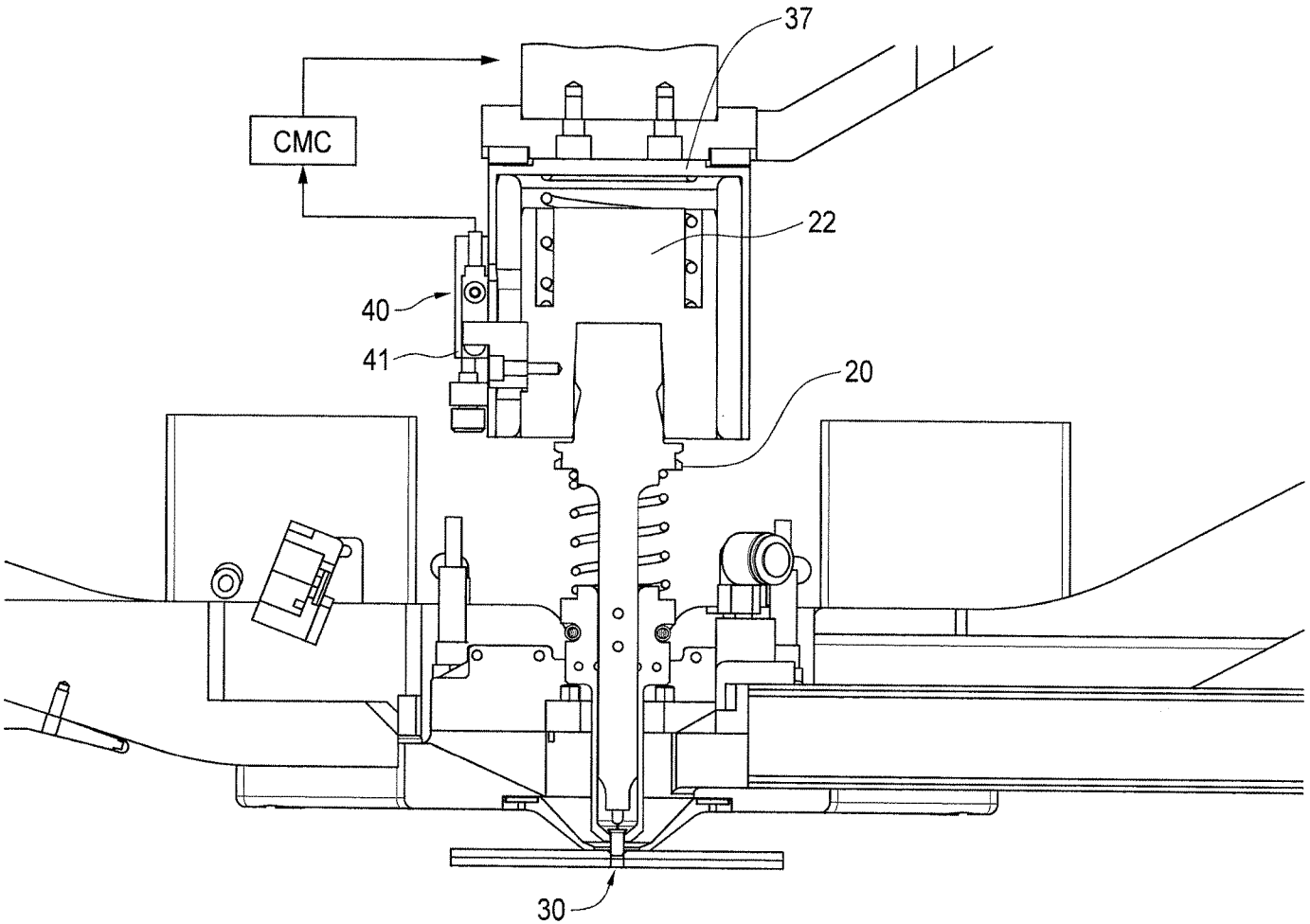
FIG. 3 is a cross-sectional view of the riveting system process at the point where the rivet tail has been correctly inserted into the opening in the workpiece.
Figure 4:
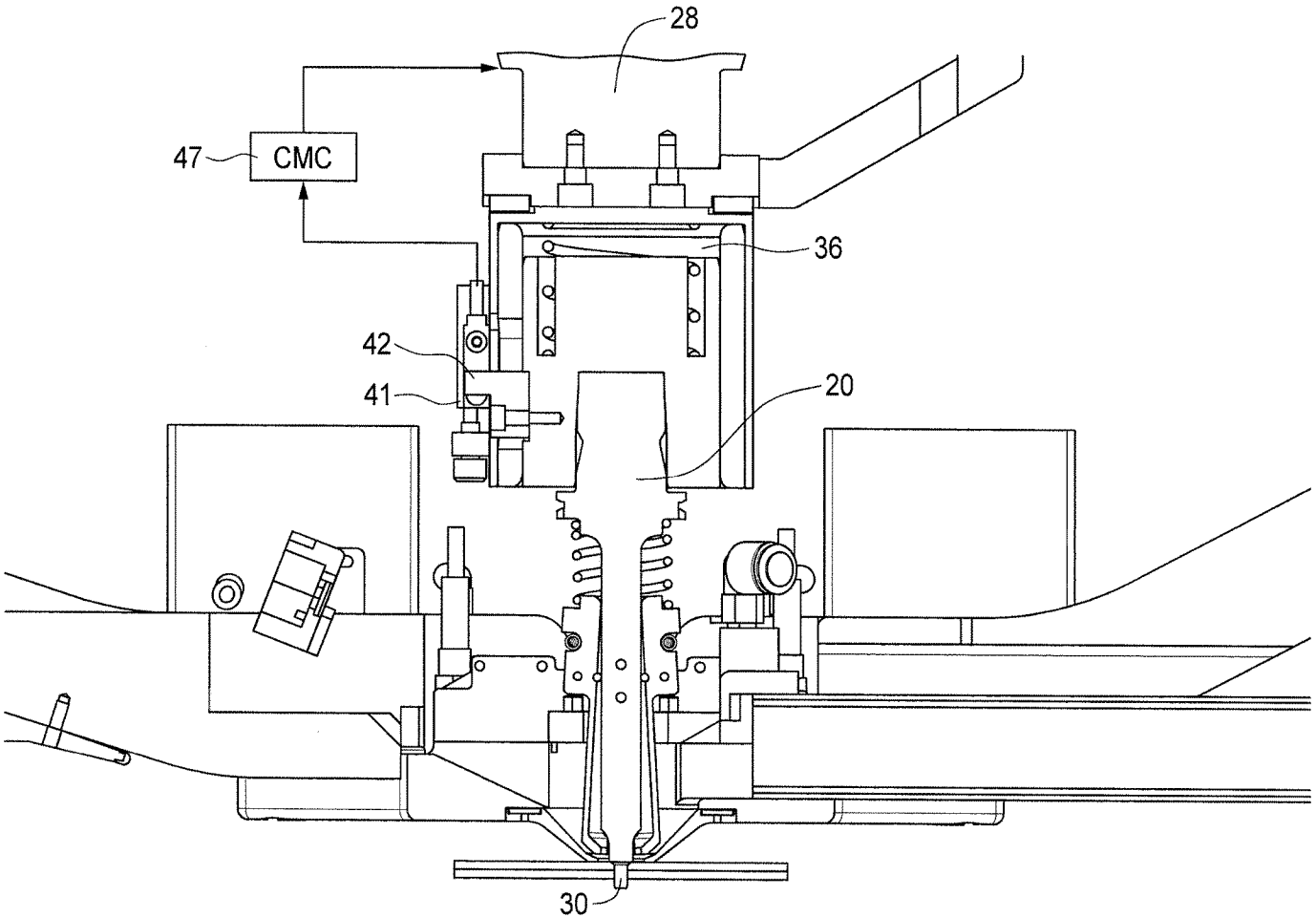
FIG. 4 is a cross-sectional view of the riveting system process when the rivet is fully inserted and the ram fingers have just released the rivet.
Figure 5:
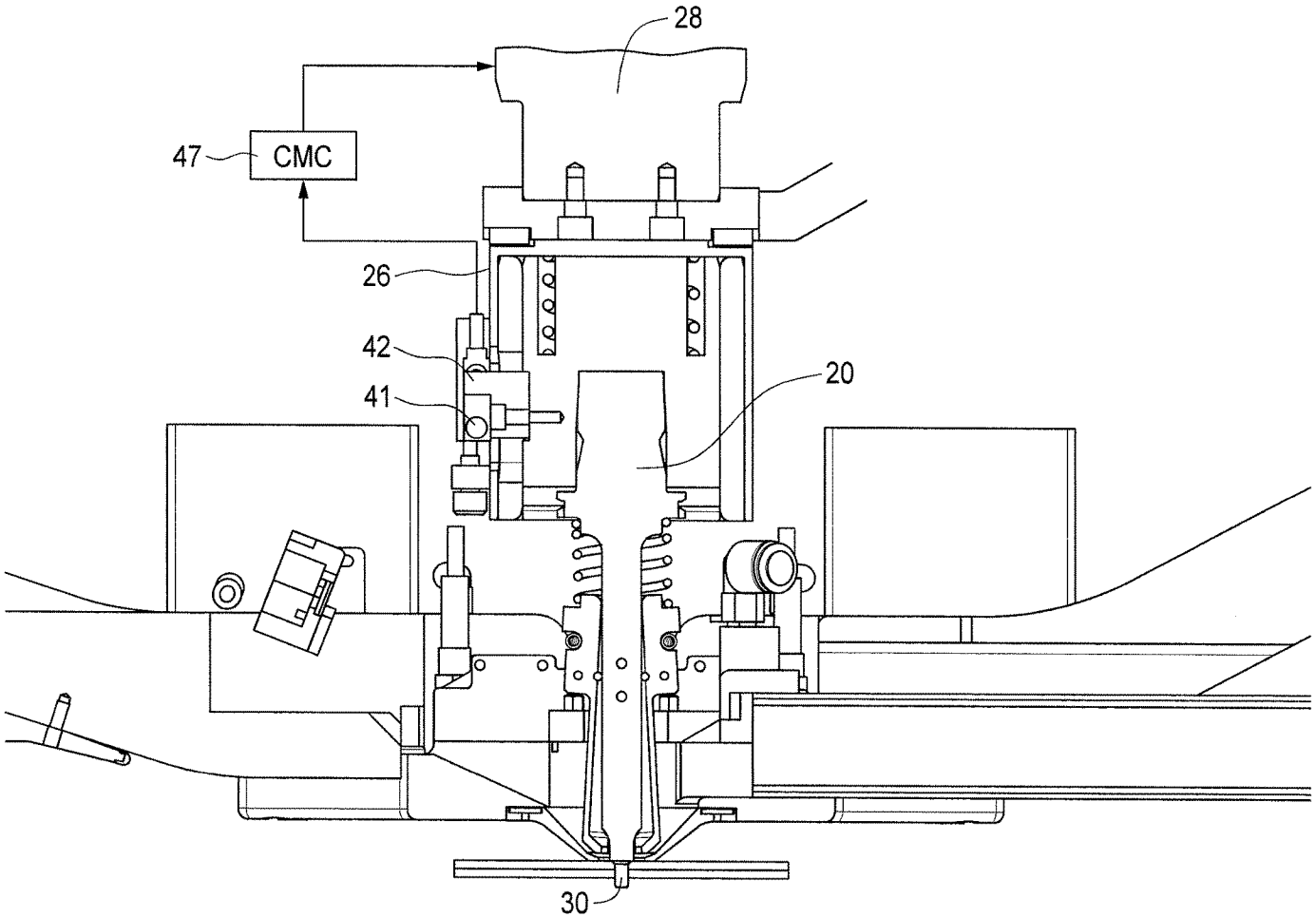
FIG. 5 is a cross-sectional view of the riveting system process at when the cycle motion controller system proceeds begins the rivet upset cycle.
Figure 6:
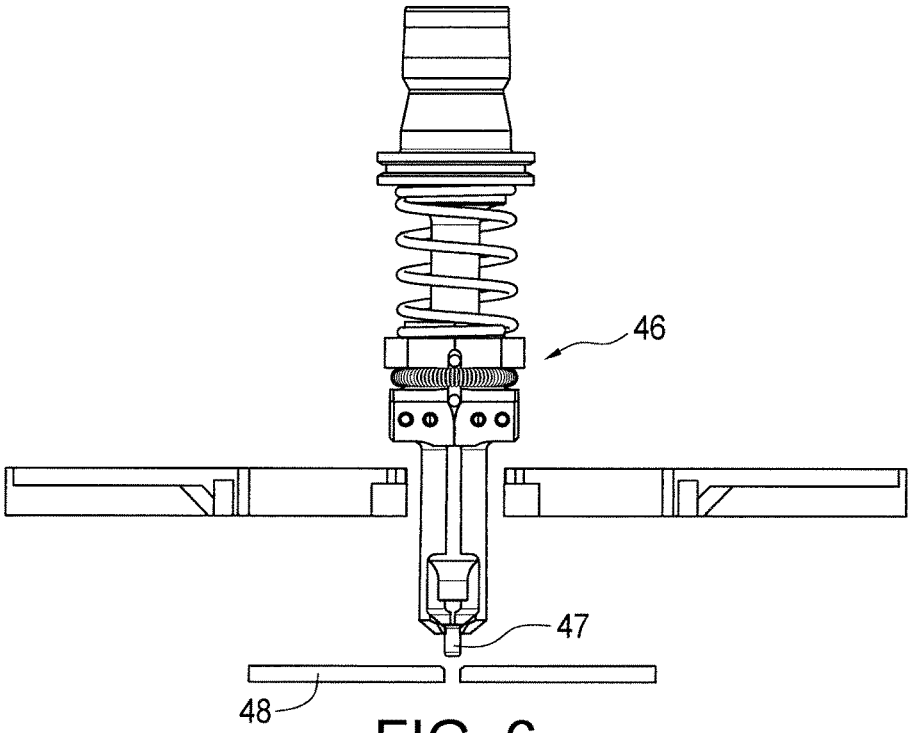
FIG. 6 is a cross-sectional view showing the operation of the ram fingers as the rivet is about to be positioned in the workpiece opening.
Figure 7:
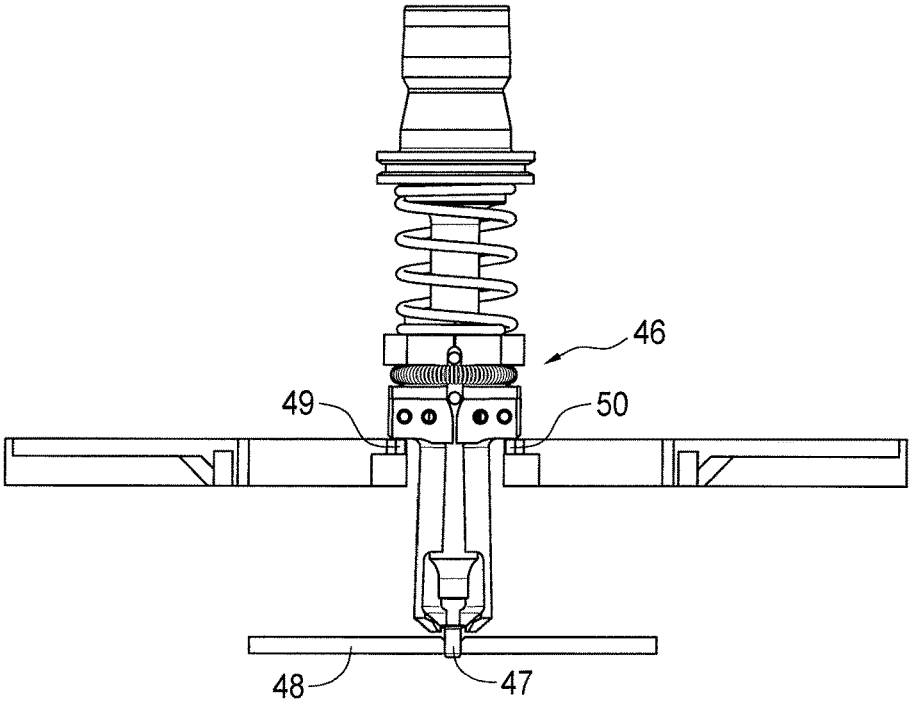
FIG. 7 is a cross-sectional view showing a rivet fully inserted into the workpiece opening, with the rivet finger assembly positioned against a stop.

FIGS. 3, 4 and 5 show the operation of the riveting system, including the protective air gap system, when a rivet is properly positioned in the workpiece opening, while FIGS. 6 and 7 show specifically the operation of the finger assembly.

Referring now to FIGS. 6 and 7, a finger assembly 46 is positioned at the lower end of the ram, and holds a rivet 47. FIG. 6 shows the position of the fingers of the finger assembly prior to reaching the workpiece opening. As the actuator moves the ram in the direction of the workpiece 48, the finger assembly encounters stop elements 48 and 50 (FIGS. 3 and 7). At this point, the rivet is normally in position in the opening, with the protective air gap 36 fully open. Further movement of the finger assembly results in the finger assembly pivoting away from the rivet, as shown in FIGS. 4 and 5. In FIG. 4, the air gap 36 is fully open, with the sensing element 41 covered by flag 42. FIG. 5 shows the rivet positioned properly within an opening in the workpiece, at which time the actuator under control of the cycle motion controller 47 proceeds with the rivet upset cycle. At this point, the actuator has driven the housing downwardly relative to the anvil socket 22, closing the air gap 36 and exposing the sensing element (sensor) 41. Correct timing of the sensor being exposed permits the rivet upset to proceed without interruption.

Figure 8:
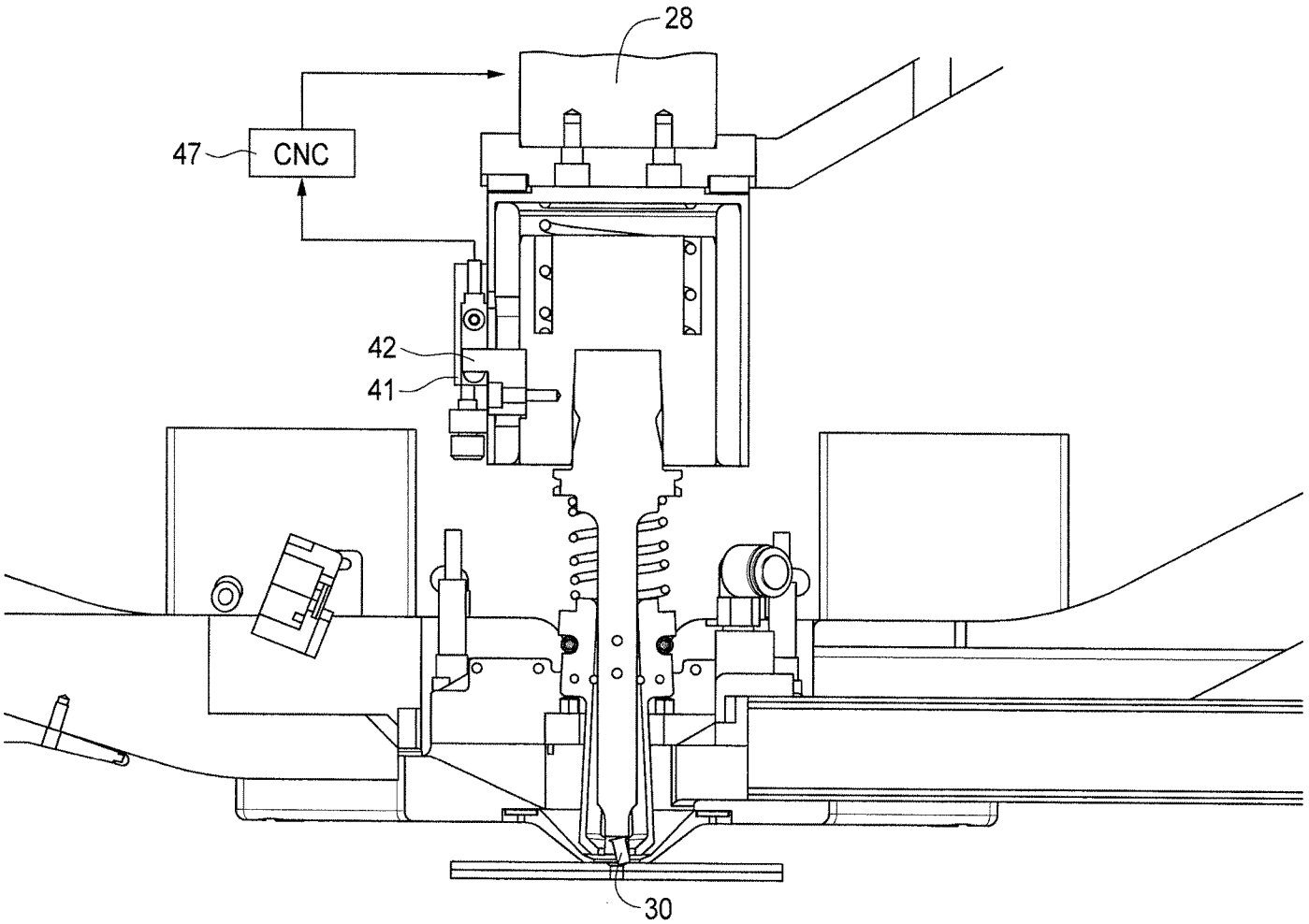
FIG. 8 is a cross-sectional view showing a jammed rivet with the machine protective air gap in place.
Figure 9:
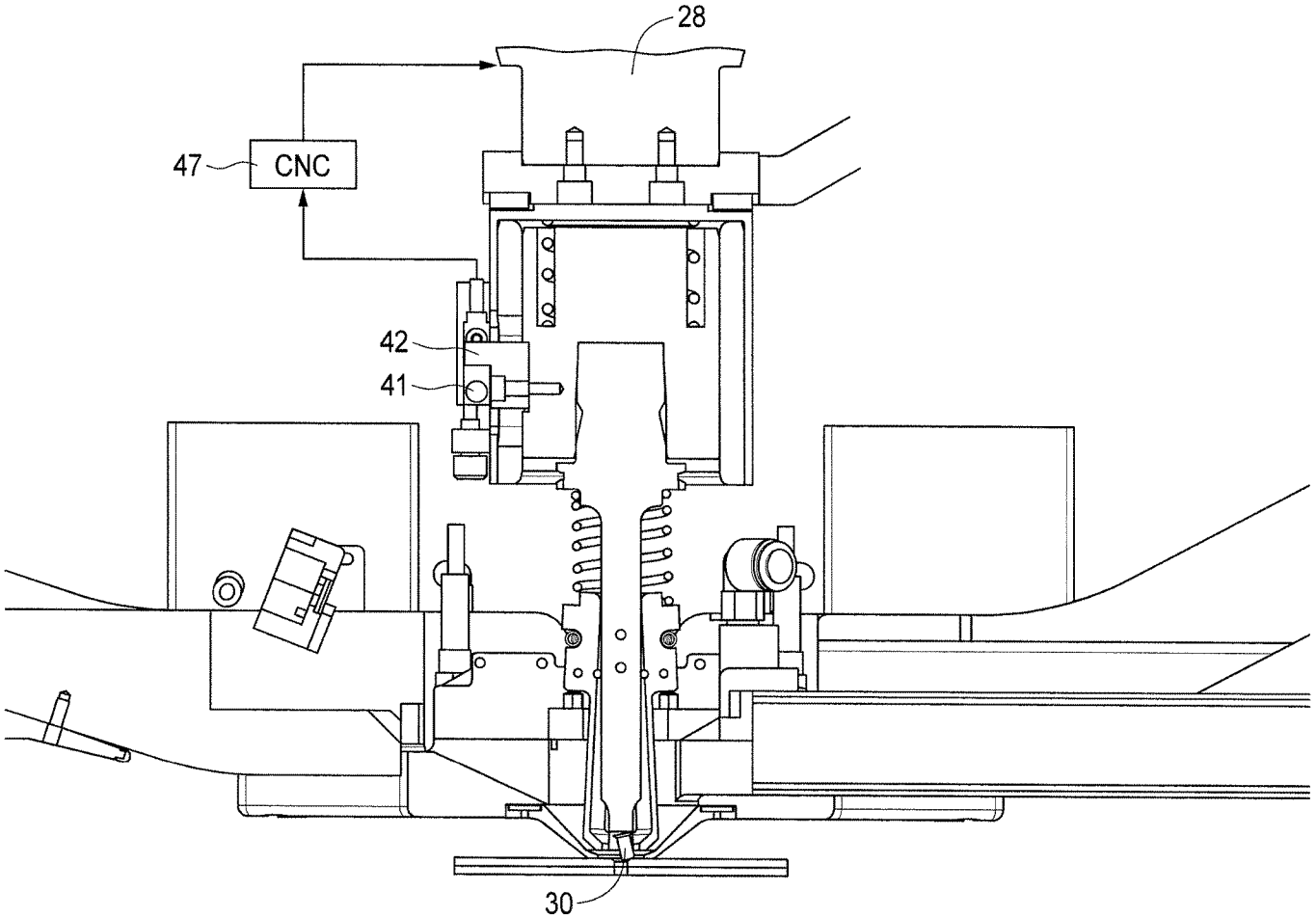
FIG. 9 shows a jammed rivet with the protective air gap nearly closed.
Figure 10:
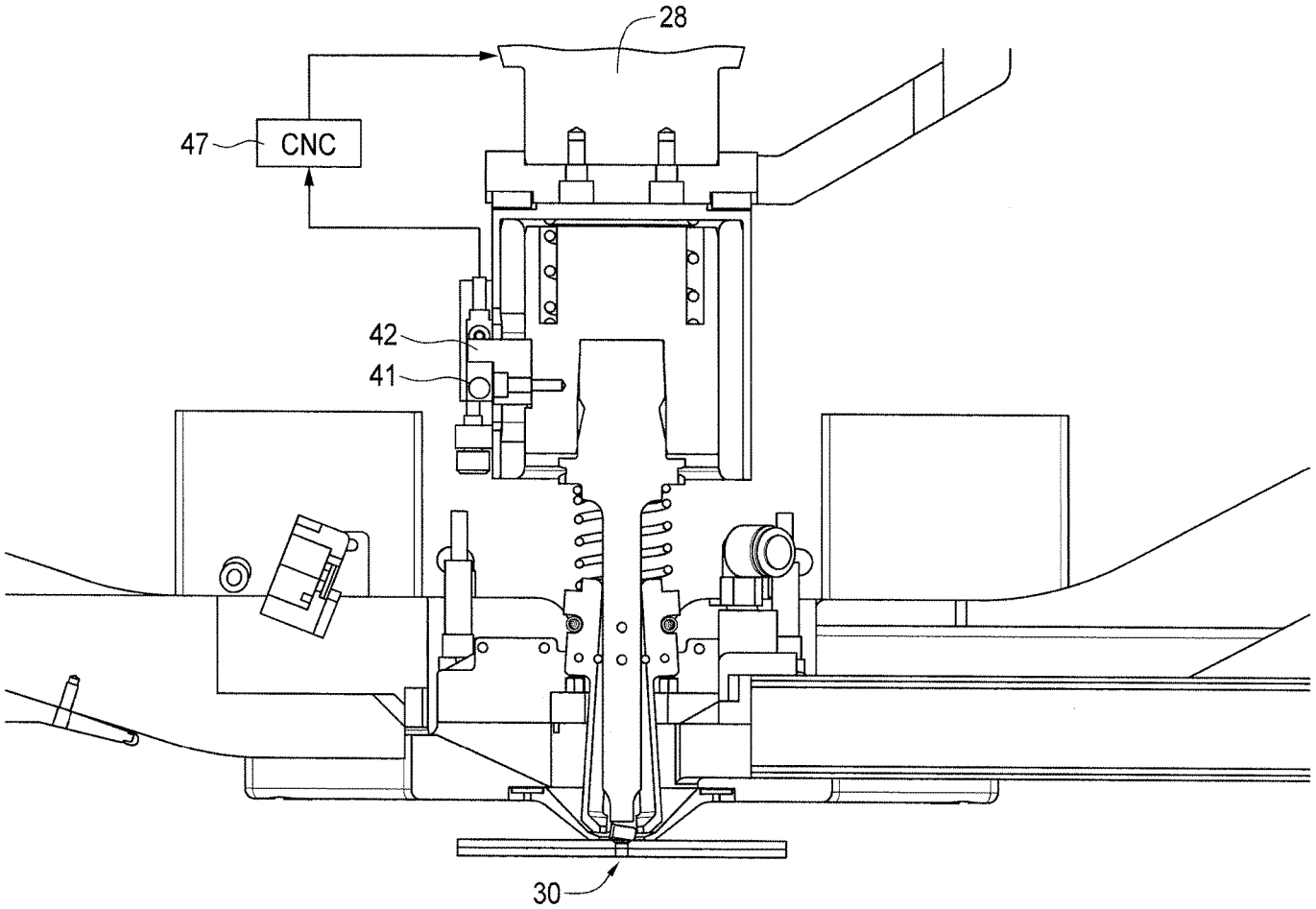
FIG. 10 is a cross-sectional view showing a sideways rivet with the protective air gap nearly closed.
Figure 14:
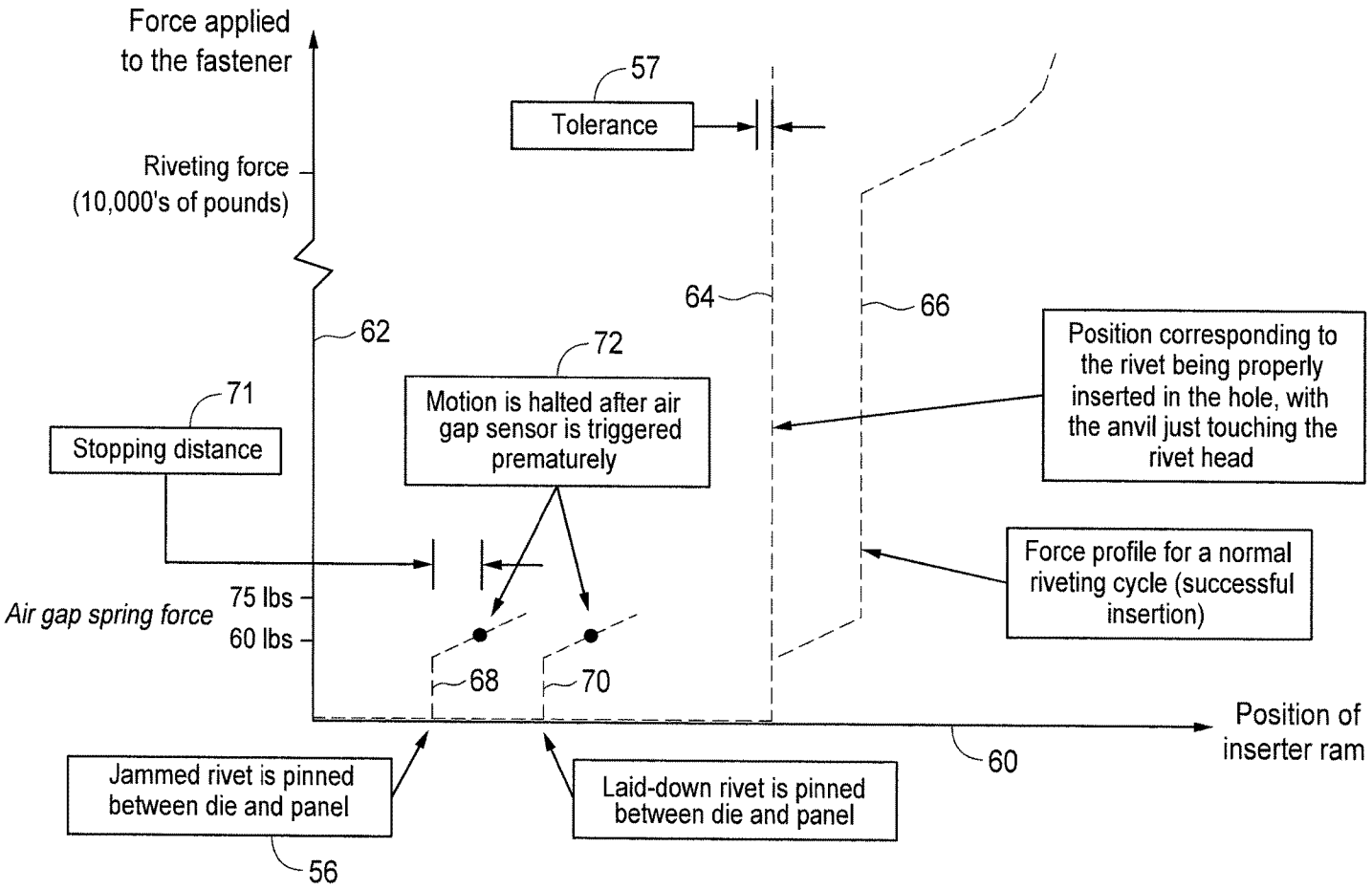
FIG. 14 is a position vs. force diagram using the protective air gap system for a failed (unsuccessful) rivet insertion.

FIGS. 8 and 9 show the sequence of operation of the protective air gap when a rivet is jammed between a panel and a ram die face, while FIG. 10 shows the air gap when the rivet is crossways across the opening in the panel (workpiece). These two circumstances produce a different time sequence between the sensor and the position of the actuator. The sequence of the protective air gap system to (1) permit upset of the rivet during normal operation and to (2) interrupt the actuator when a rivet is jammed or crosswise is shown in FIG. 14. A jammed rivet or sideways rivet results in an early change of state of the sensor, as it is uncovered. The cycle motion controller recognizes the early change of state as an error, the riveting cycle is stopped and an error message is generated. This is accomplished before upset force is applied to the ram assembly, thereby preserving the workpiece from damage.

With a properly inserted rivet, FIG. 14 illustrates an acceptable range of initiation air gap closure, referred as a tolerance 57. If the cycle motion controller recognizes an early change of sensor state, indicating an error in the rivet insertion process, the cycle motion controller will interrupt (halt) the riveting cycle and generate an error message, preventing damage to the workpiece. Early change of state means that the inserter ram is further back along the position axis 60 than is ideal, i.e. before the tolerance line 57. When the air gap begins to close prior to the ram reaching an acceptable range of positions, the early sensor change of state relative to the position of the ram indicates a jammed rivet, as referenced at 56. The housing with the sensor moves toward the workpiece, while the anvil socket (with the flag) remains in position, since the die is against the jammed rivet. The air gap will also begin to close early for a sideways rivet. FIG. 14 also illustrates this, which is discussed in more detail below. The early change of signal state of the sensor for a sideways rivet will also be recognized by the cycle motion controller, which halts the insertion cycle, preventing damage, and generates an error message.

In more detail, referring to FIG. 14, along the horizontal axis 60 is the position of the inserter ram, while the vertical axis 62 shows the riveting force applied to the fastener. The air gap spring force is shown at 60-75 pounds fully extended, which increases in accordance with spring rate. The dotted line 64 shows the position which corresponds to the rivet being properly inserted into the opening, while dotted line 66 shows the force profile for a normal riveting cycle with a successful insertion. The inserter ram will encounter the rivet at different positions if the rivet is jammed, referred to at dotted line 68, or if the rivet is sideways, i.e. laid down, referred to at dotted line 70. The stopping distance 71 for the actuator is shown for each case after the premature triggering 72 of the air gap sensor is recognized. This shows the advantage of the present system in which the initial force of the ram, i.e. above 60 pounds, produces a change of state in the sensor which in turn is recognized by the cycle motion controller as an error if it is early, as defined above. The cycle motion controller interrupts the normal cycle, halting the application of riveting force (10,000 of pounds) by the actuator in sufficient time to prevent damage to the workpiece. There is no interruption of rivet action to the right of line 64 for the position of the inserter ram. The use of the air gap for interrupting the normal riveting cycle is for premature triggering of the air gap sensor, as shown in FIG. 14.

The present system can also be used to identify when a bolt has been jammed in an opening in the workpiece or is positioned sideways, although the vast majority of use of the present air gap system is for rivets. The shank diameter of a bolt fastener is typically at least 0.001 inches larger than the diameter of the opening, while the threads at the forward end (tip) of the bolt have an outside diameter which is smaller than the diameter of the opening. Accordingly, during successful bolt insertion, the threaded portion first slips into the opening without resistance, and then as the shank begins to enter the opening, a significant amount of force, typically thousands of pounds, is required to drive it the rest of the way in. The position where the threads are fully inserted and the shank is just beginning to enter the opening is referred to as the "stake" position. Using the present system, detection of staking can be achieved, because the force required to press the bolt in further is much higher than the force that the air gap spring exerts, so that the air gap will begin to close immediately upon the occurrence of staking.

For a given bolt length, the distance between the bolt head and the point where the bolt shank begins to transition to the threaded portion is well known. This distance determines how far the bolt will protrude from the panel when it is staked. If a bolt which has been staked is too long or too short, the bolt will protrude from the panel by the wrong distance. When the air gap sensor is triggered, the known position of the bolt-inserting ram can be used to measure the protrusion distance. The machine is programmed with the nominal acceptable tolerance protrusion distance for each length of bolt that the machine installs, so that an acceptance tolerance band can be specified.

Figure 11:
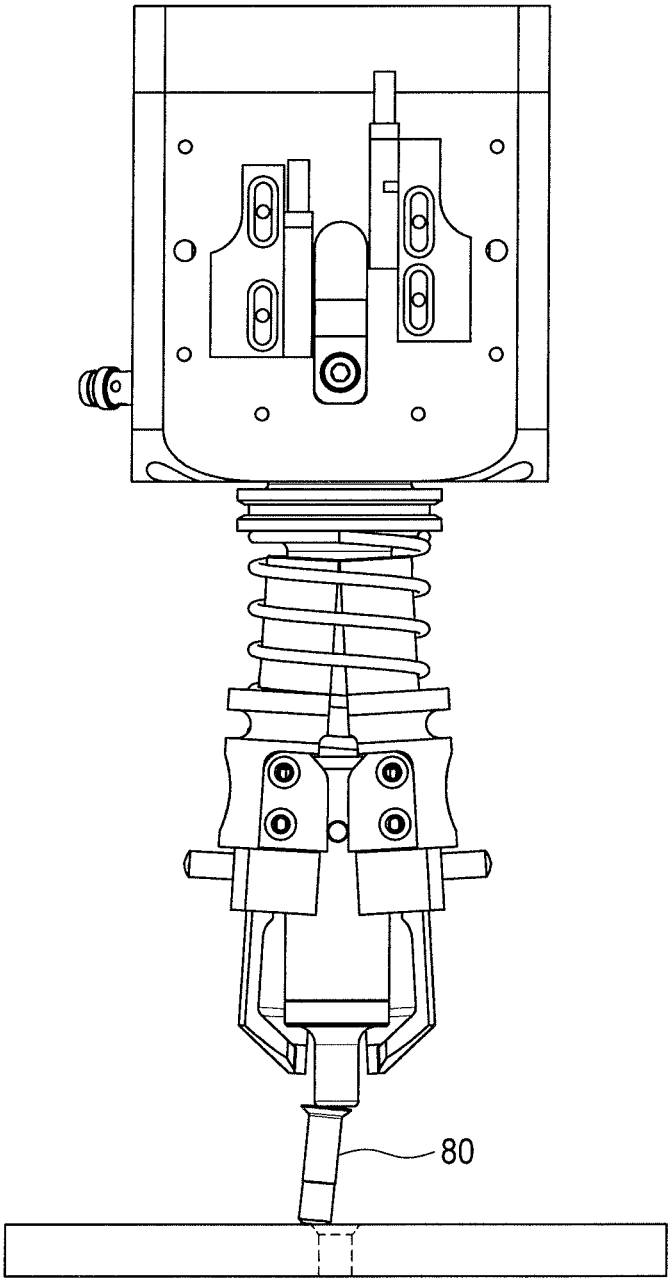
FIG. 11 is a cross sectional view showing a jammed bolt.
Figure 12:
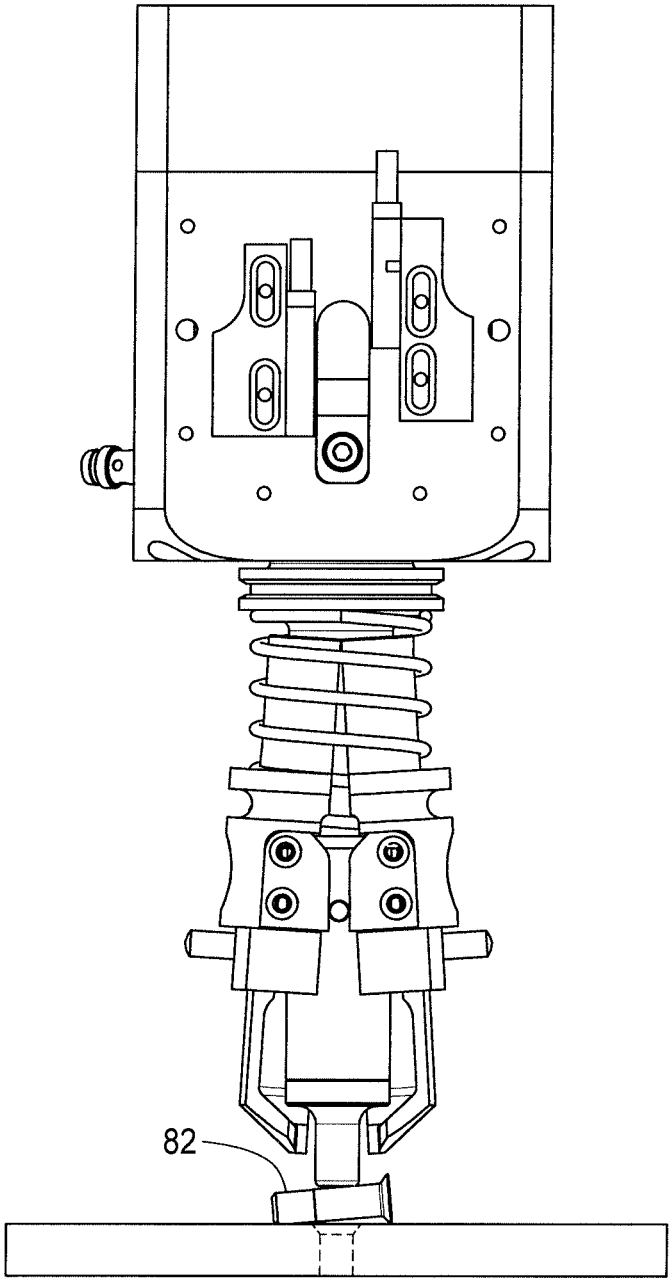
FIG. 12 is a cross-sectional view showing a sideways bolt.
Figure 13:
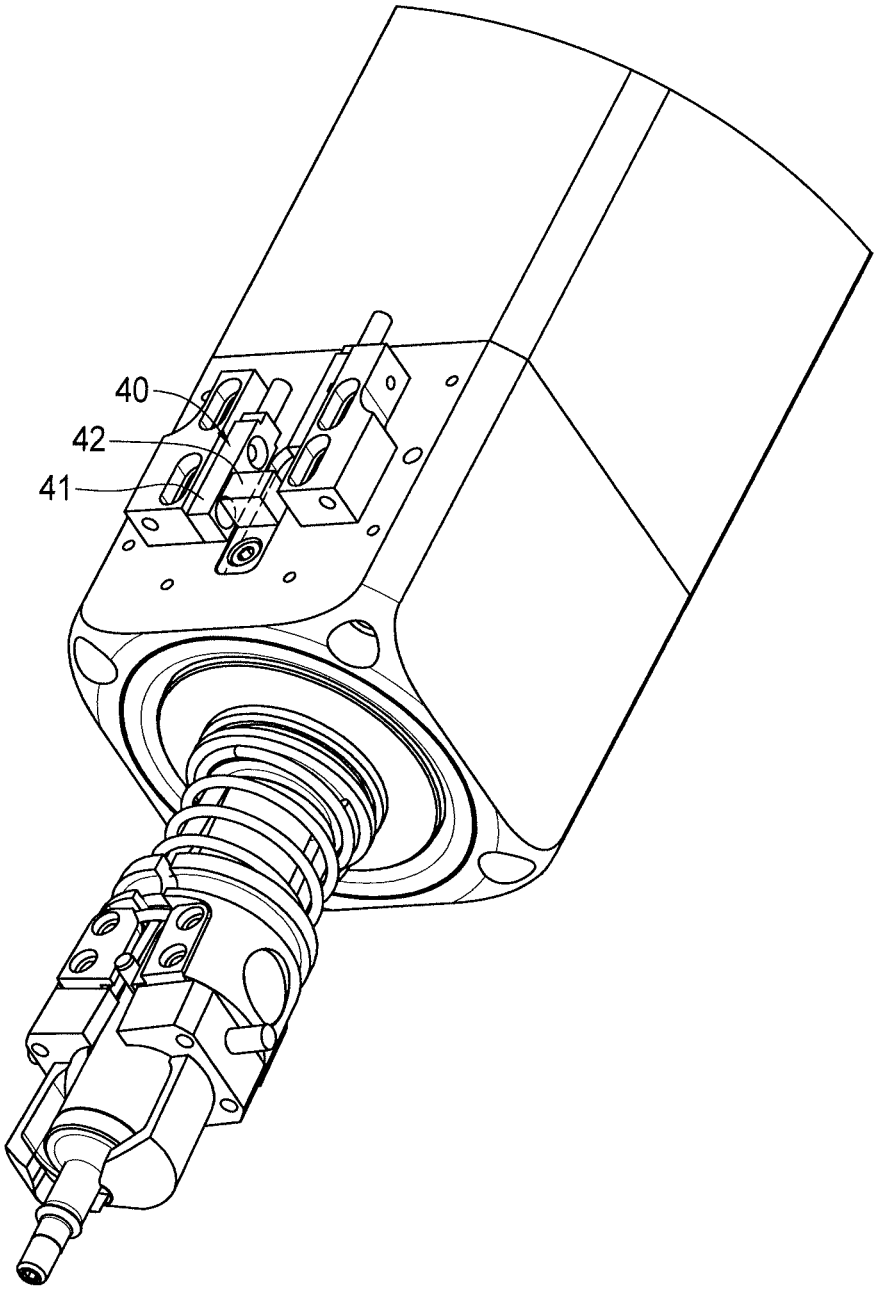
FIG. 13 is an elevational view showing the sensing mechanism for the protective air gap system.

If the measured protrusion deviates from the nominal acceptable protrusion distance by more than the specified tolerance, the normal cycle of insertion is interrupted. Typically, when the air gap begins to close too early, i.e. before tolerance range 63 in FIG. 15, the bolt 65 is jammed, as shown in FIG. 11, referenced at 67. The cycle motion is halted as shown at 69. If the air gap begins to close too late, beyond tolerance range 63 (to the right in position axis 86), the opening in the workpiece may be too large so there is no interference for the bolt, or the bolt may be laid down, as shown in FIG. 12. If the bolt is jammed, the air gap closes prematurely when the housing, with sensor 41, as shown in FIG. 13, moves toward the workpiece while the anvil socket with the ram and the flag remains in position, prevented from moving by the jammed rivet. The sensor changes state as it is uncovered. An early change of state is recognized as an error by the cycle motion controller, which interrupts (halts) the cycle before the high insertion force is applied to the bolt and then generates an error message. If the bolt is sideways, such as shown in FIG. 12, or the hole is oversized, then the ram with the die will continue to move past (to the right of) the tolerance range 63 shown in FIG. 15, which corresponds to a properly positioned bolt. Once the position of the inserter ram moves past the tolerance range 63, with no recognition that the sensor has changed state, indicating that the air gap has not started to close (the air gap closing is thus late), the cycle motion controller will interrupt the normal insertion cycle, preventing catastrophic damage to the workpiece and generates an error message.

Figure 15:
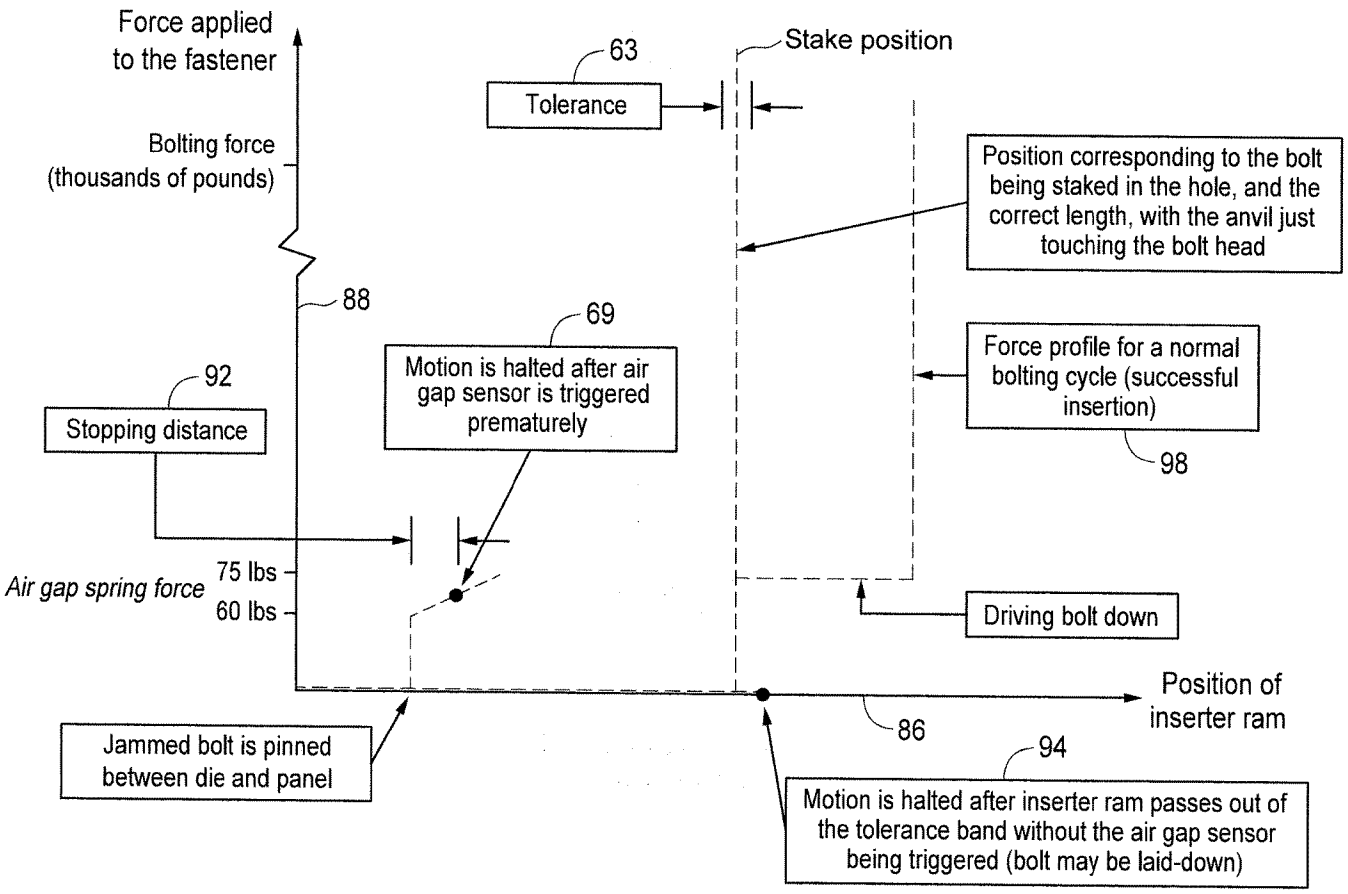
FIG. 15 is a position vs. force diagram using the protective air gap system for a failed (unsuccessful) bolt insertion.

FIG. 15 shows the position/force diagram for detection of an unsuccessful bolt insertion using the present air gap protective system. Along the horizontal axis 86, is the position of the inserter ram 12, while the vertical axis 88 represents the force applied to the fastener. As the ram moves, if a bolt is pinned between the die and the panel (workpiece), the sensor will be uncovered and triggered prematurely (early change of state). The cycle motion controller will recognize the error, will interrupt the insertion cycle and generate an error message, shown at 69. This is accomplished in the relatively short distance of travel of the inserter ram referred to at 92, with the interruption occurring prior to any damage to the workpiece.

On the other hand, if the position of the inserter ram moves past the tolerance range 69, to the right on position axis 86, without the sensor changing state, the motion controller will recognize this error as well and interrupt the cycle, preventing any damage to the workpiece. An error message is also generated. This is typically indicative of a sideways laid down bolt or an oversize hole or an undersize bolt. The force profile for a normal bolt cycle and the successful insertion is referenced at 98.

Accordingly, the present invention is capable of identifying jammed rivets and bolts as well as sideways rivets and bolts and to interrupt the normal high force cycle action to prevent damage to the workpiece, as well as generating an error message. In operation, the insertion ram is driven toward the workpiece by a servo-motor, which is controlled by a cycle motion controller. The protective air gap is monitored by a combination of a sensor assembly and the cycle motion controller. If the sensor changes state early or changes state late (only for an interference fit bolt), the cycle motion controller will recognize the error and will interrupt the rivet/bolt insertion force cycle and generate an error message.

There is some system reaction time, referred to as a delay, between a failed/incomplete insertion and the interruption of the insertion cycle. Most of the delay is due to the time it takes for the ram to actually decelerate to a halt after it received the interrupting signal from the cycle motion controller.

The fastener insertion system, in terms of maximum possible deceleration, is limited. If the insertion system is driven toward the workpiece at its maximum speed, a long distance may be required for it to decelerate and come to a complete stop, preventing damage to the workpiece. The time it takes to decelerate and therefore the distance traveled during deceleration can be reduced by driving the system at a reduced speed.

Accordingly, a system has been described and shown which identifies a misaligned rivet or bolt, specifically, those not properly entering the opening in the workpiece. After identification of such a circumstance, an error signal is sent which is then transmitted to the cycle motion controller, which interrupts the insertion process, saving the workpiece from damage.

Although a preferred embodiment of the invention has been disclosed for purposes of illustration, it should be understood that various changes, modifications and substitutions may be incorporated in the embodiment without departing from the spirit of the invention, which is defined by the claims which follow.

What is claimed is:

1. A system for accomplishing riveting or bolt insertion into an opening in a workpiece without damage to the workpiece, comprising:

a ram assembly, including a ram assembly driving member and a ram assembly driven member, the ram assembly driven member having fingers for grasping a fastener;

an actuator for moving the ram assembly driving member under control of a cycle motion controller in order to first insert the fastener into an opening in the workpiece and thereafter to complete an insertion cycle for the fastener in the opening;

a protective air gap assembly responsive to movement of the ram assembly driven member toward the workpiece, including an air gap located between the ram assembly driving member and the ram assembly driven member, the air gap being held open by a selected amount of force; and a sensor assembly mounted and operable to recognize closing of the air as the ram assembly driving member is moved toward the workpiece by the actuator, wherein the sensor assembly has a signal state which is monitored by the cycle motion controller, the insertion cycle of the fastener being interrupted prior to force sufficient to complete the insertion cycle being applied to the ram assembly in the event that the air gap begins to close at a time other than when closure of the air gap begins when the fastener is properly first inserted in the workpiece opening.

2. The system of claim 1, wherein the cycle motion controller generates an error message when the insertion cycle is interrupted.

3. The system of claim 1, wherein the selected amount of force is in the range of approximately 60-75 pounds.

4. The system of claim 1, wherein the air gap is approximately 9 mm.

5. The system of claim 1, wherein the sensor assembly includes a sensor located on the driving member and a flag member mounted on the driven member and wherein the sensor changes state when the sensor is uncovered from the flag member.

6. The system of claim 1, wherein the fastener is jammed in the opening, or pinned between the ram and the workpiece, such that the air gap begins to close at a time before closure begins when a fastener is properly inserted in the workpiece opening.

7. The system of claim 1, wherein the fastener is positioned sideways, such that the air gap begins to close for a rivet fastener at a time before closure begins for a properly inserted rivet and for a bolt fastener at a time after closure begins for a properly inserted bolt.

8. The system of claim 1, wherein the fastener is a rivet.

9. The system of claim 1, wherein the fastener is a bolt.

10. The system of claim 1, wherein the cycle motion controller controls the ram assembly to move initially at a selected high speed, until the fastener is being inserted, at which point the speed is reduced.

11. The system of claim 1, wherein the fastener is a bolt and wherein the insertion cycle is interrupted when the bolt is laid down or there is no interference fit for the bolt in the opening.

* * * * *